US010577066B1

(12) United States Patent
Thomas

(10) Patent No.: US 10,577,066 B1
(45) Date of Patent: Mar. 3, 2020

(54) VESSEL HANDLE AND PADDLE CLIP

(71) Applicant: James Thomas, Bellingham, WA (US)

(72) Inventor: James Thomas, Bellingham, WA (US)

( * ) Notice: Subject to any disclaimer, the term of this patent is extended or adjusted under 35 U.S.C. 154(b) by 0 days.

(21) Appl. No.: 16/035,315

(22) Filed: Jul. 13, 2018

Related U.S. Application Data

(60) Provisional application No. 62/535,185, filed on Jul. 20, 2017.

(51) Int. Cl.
*B63H 16/04* (2006.01)
*B63H 16/073* (2006.01)
*B63B 35/71* (2006.01)

(52) U.S. Cl.
CPC ..... *B63H 16/073* (2013.01); *B63B 2035/715* (2013.01)

(58) Field of Classification Search
CPC ..... B63B 2035/715; B63H 16/04; B63H 2016/043; B63H 2016/046; B63H 16/06; B63H 2016/063; B63H 16/067; B63H 16/073
See application file for complete search history.

(56) References Cited

U.S. PATENT DOCUMENTS

| | | | | |
|---|---|---|---|---|
| 8,915,207 | B2 * | 12/2014 | Wirsig | B63B 39/00 114/364 |
| 9,499,235 | B1 * | 11/2016 | Blavat | B63B 17/00 |
| D785,540 | S * | 5/2017 | Olliges | D12/317 |
| 9,663,208 | B1 * | 5/2017 | Blavat | B63H 16/06 |
| 2018/0186440 | A1 * | 7/2018 | Mech | B63H 16/073 |

* cited by examiner

*Primary Examiner* — Andrew Polay
(74) *Attorney, Agent, or Firm* — Schacht Law Office, Inc.; Dwayne Rogge

(57) ABSTRACT

This disclosure relates to the field of accessories to water vessels (watercraft) such as kayaks, surfboards, paddle-boards, etc. where a paddle or oar is carried. The combined vessel handle and paddle clip comprises an exterior grasping surface and an interior surface configured to frictionally retain a paddle.

5 Claims, 2 Drawing Sheets

VESSEL HANDLE AND PADDLE CLIP

RELATED APPLICATIONS

This application claims priority benefit to U.S. Patent Application 62/535,185 filed on Jul. 20, 2017 incorporated herein by reference.

FIELD OF THE DISCLOSURE

This disclosure relates to the field of accessories to water vessels (watercraft) such as kayaks, surfboards, paddleboards, etc. where a paddle or oar is used.

BRIEF SUMMARY OF THE DISCLOSURE

This disclosure specifies a device to be attached to water vessels (watercraft) such as kayaks, surfboards, paddleboards, etc. where a paddle or oar is carried.

The combined vessel handle and paddle clip in one example comprises an exterior grasping surface and an interior surface configured to frictionally retain a paddle having a shaft.

In another example is disclosed a combined vessel handle and paddle clip comprising: a plurality of resilient arms each having an outer surface forming an exterior grasping surface; the plurality of resilient arms forming an interior surface with an inner diameter, the interior surface configured to frictionally retain a paddle; the plurality of resilient arms having distal ends forming an opening to the inner surface; the resilient arms configured such that a portion of the paddle will pass, spreading the distal ends of the resilient arms and be retained as the widest part of the paddle passes the distal ends of the resilient arms; the exterior grasping surface configured to be grasped by a user; a mounting surface at each longitudinal end of the grasping surface; and each mounting surface configured to mount the combined vessel handle and paddle clip to an exterior surface of the vessel.

The combined vessel handle and paddle clip as recited in another example comprises: the exterior surface of the vessel; a handle recess in the exterior surface of the vessel; and wherein the combined vessel handle and paddle clip is mounted to the recess of the vessel and thus substantially does not protrude outwardly of the surrounding exterior surface of the vessel beyond the handle recess.

The combined vessel handle and paddle clip may be arranged wherein the paddle clip inner diameter inward of the distal ends is configured to be substantially equal to a shaft outer diameter of the paddle.

The combined vessel handle and paddle clip may be arranged wherein each mounting surface comprises a surface defining a void configured to allow passage of a fastener therethrough, the fastener configured to mount the combined vessel handle and paddle clip to the vessel.

The combined vessel handle and paddle clip may be configured to comprising an offset distance or gap between the grasping surface and the exterior surface of the vessel.

DETAILED DESCRIPTION OF THE DISCLOSURE

In the field of watercraft, particularly small watercraft (vessels) such as kayaks (whitewater, sea, sit-in, and sit-on-top), canoes, rafts, paddleboards, stand-up-paddleboards, and similar vessels, it is often desired to keep the user's hands free while not holding a paddle or oar (paddle). Such activities include getting in and out of the vessel, fishing, sailing, etc.

Prior to invention of the disclosed vessel handle and paddle clip, a paddle when carried on the vessel was laid to rest on or in the vessel, or tied to the vessel, often getting in the way and not readily available as it needed to be untied to be used. When the paddle was simply laid to rest in or on the vessel, the paddle may be in the way of other activities, or may have fallen off of the vessel, possibly leaving the vessel user without means of propulsion back to the paddle or to other safety location.

Many of these vessels are small and light enough to be lifted and/or carried by one or more users. Thus, a carrying handle may be provided as a component of the vessel that may be grasped by the user(s) for lifting and/or carrying the vessel. Commonly these handles have opposing ends which are affixed to the hull of the vessel, with a grasping portion provided between the ends although other configurations may be conceived and implemented. These handles are often provided near the balance point of a single-user vessel, and at even positions along the vessel for more than one user. Thus it has been found they are often in a particularly beneficial position for attachment of components to be accessed by users.

Figure 1:
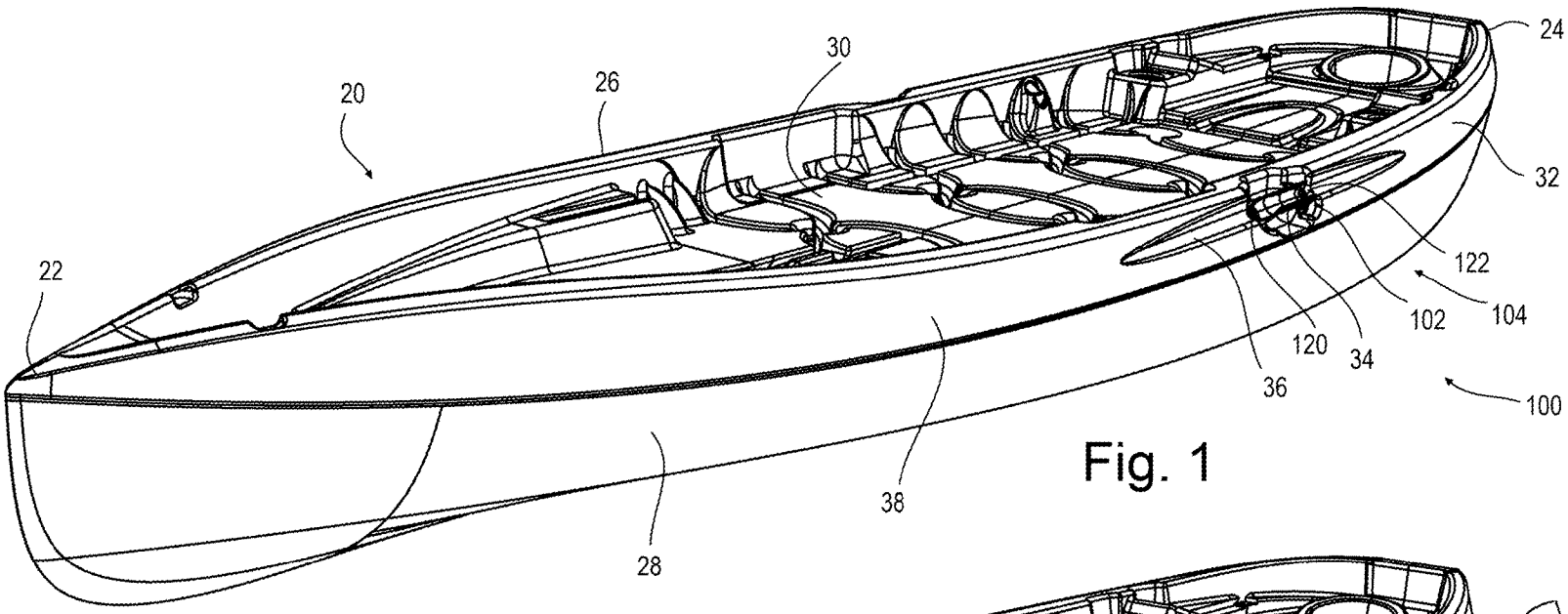
FIG. 1 is a perspective side view of a vessel with the disclosed vessel handle and paddle clip.
Figure 2:
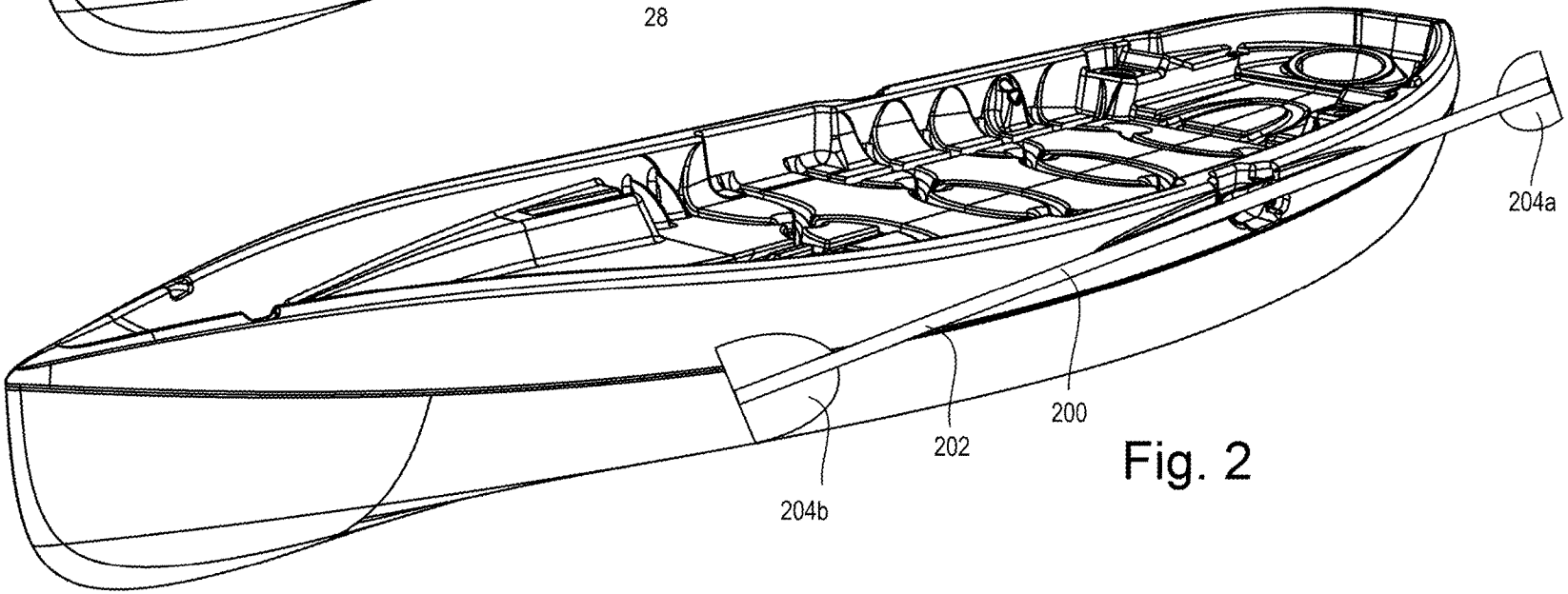
FIG. 2 is a perspective side view of a vessel with the disclosed vessel handle and paddle clip.
Figure 3:
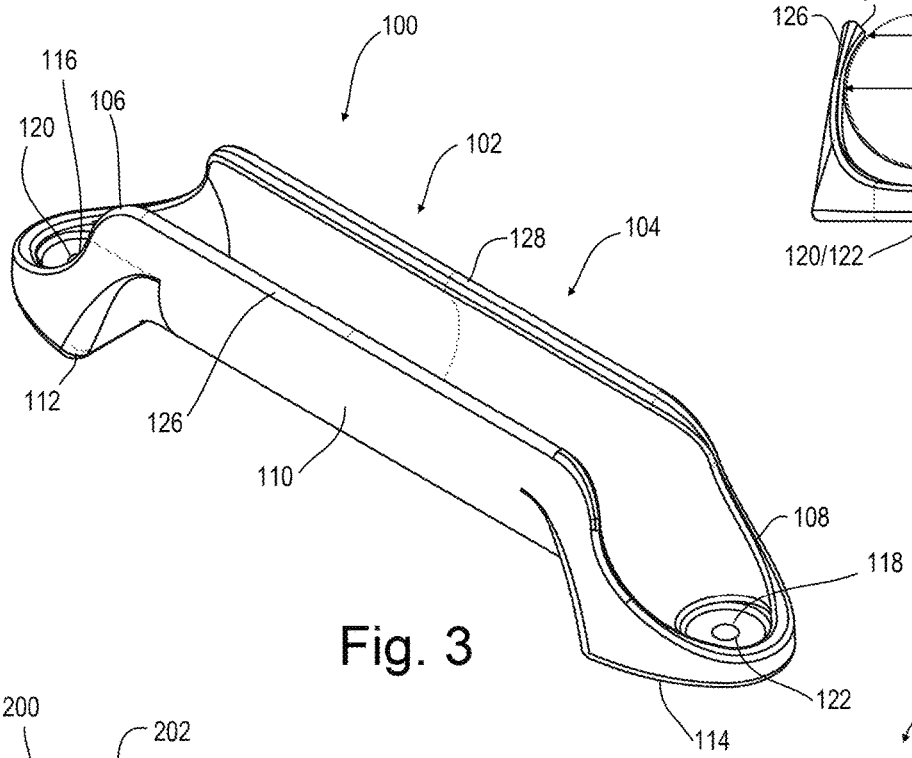
FIG. 3 is a perspective view of the vessel handle and paddle clip shown in FIG. 1.

Looking to FIG. 1 and FIG. 2 is shown a vessel 20 which in this example is a sit-on-top style kayak. The vessel 20 having a forward end or bow 22, a rearward end or stern 24, a right or starboard side 26, and a left or port side 28. These components of the vessel 20 forming in varying combinations, a hull 32 which floats the operator substantially on the surface of water. The vessel 30 may have seats 30 upon which users sit.

These drawings also show a paddle attachment system 100 comprising the vessel handle 102 with a paddle clip 104 for removable attachment of a paddle 200 as shown in FIG. 2. By utilizing the handle 102 to also retain the paddle 200, fewer components are required for manufacture over examples using separate paddle attachments and handles, the clip 104 may be optimally positioned on and/or attached to the hull 32 while not interfering with use of the handle 102.

FIG. 1 and FIG. 2 show a particular example where the hull 32 includes a handle recess 34 indented into the hull. The handle 102 with paddle clip 104 in this example is positioned within a handle recess 34 of the hull 32. As such, the handle 102 is at least partially recessed into the port side 28 so that the handle 102 does not impact other vessel, docks, or other external obstructions in the area where it is recessed into the recess 34.

When the handle 34 is in a recessed position as shown, it may be desired to include a paddle recess 36 in the hull 32. The paddle recess extending longitudinally in this example from the handle recess 34 such that as the paddle 200, particularly the shaft 202 of the paddle 200 is secured into the paddle clip 104 portion of the handle 34, the hull 32 will not interfere with retention of the shaft 202. This also may substantially recess at least a portion of the shaft 202 portion of the paddle 200 from impact with other vessel, docks, or other external obstructions.

Generally, such paddles 200 will comprise the shaft 202 which is grasped by the user when used to propel the vessel 20 and a blade or blades 204*a* and 204*b* on the end(s) of the shaft 202. The blades 204 (204*a* and 204*b*) inserted in the water upon which the vessel floats and the paddle 200 moved by the user to propel the vessel.

Figure 5:
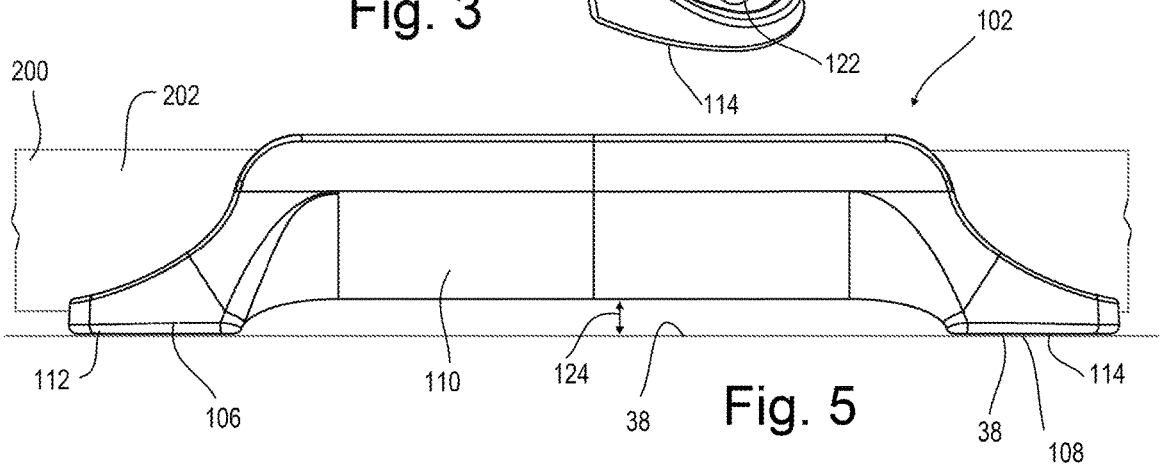
FIG. 5 is a side view of the vessel handle and paddle clip shown in FIG. 1 with the opposing side view being a mirror image thereof.
Figure 6:
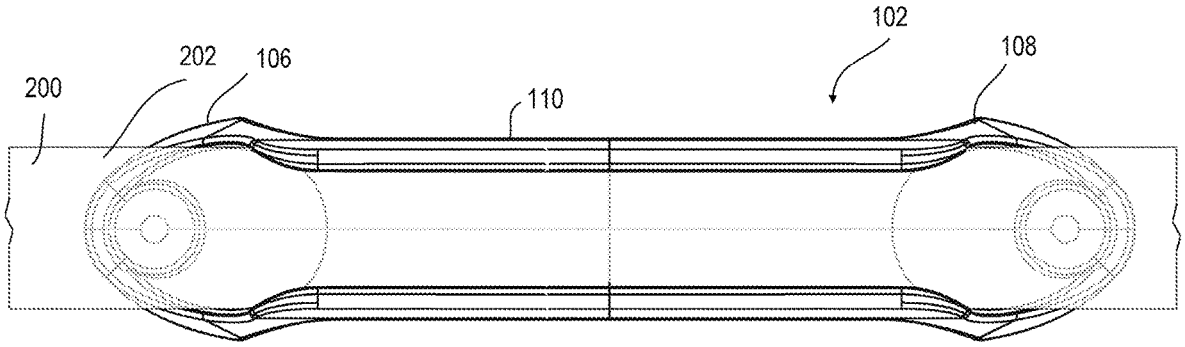
FIG. 6 is a top hidden line view showing the bottom surfaces in lightened lines.

Looking to FIG. 5 is a detailed enlarged view of one example of the handle 102 component of the paddle attachment system 100 with paddle clip 104. The handle 102 of this example is shown removed from the vessel 20 to more clearly show the component.

In this example, the handle 102 has a first end 106 and a second end 108 with a grasping portion 110 there between. The grasping portion 110 of this example is ergonomically shaped for ease and comfort for the user to grab and lift the vessel 20. In the example shown, the outer surface of the grasping portion 100 is substantially cylindrical as can be more easily seen looking at FIG. 4. In this example the first end 106 and second end 108 each comprise a mounting surface 112/114 respectively for contact and attachment to an outer surface 38 of the vessel 20 or handle recess 34 thereof. In the example shown, the outer surface 38 includes the surface defining the handle recess 34 where the handle 102 is attached.

The first end 106 and second end 108 of the handle 102 may also comprise surfaces defining voids 116/118 respectively. These voids 116/118 provided for passage of fasteners 120/122 respectively into the outer surface 38 of the vessel 20. These fasteners 120/122 may be screws, bolts, rivets, studs, etc. In another example the handle 102 may be adhered to the surface 38 by way of an adhesive. In yet another example, the handle 102 may be formed as a unitary structure with the outer surface 38 or other part of the vessel 20.

It can be seen in FIG. 5 that in this example, the grasping portion 110 is offset from the outer surface 38 of the vessel 20 by an offset distance 124 or gap. This offset 124 distance or gap making it easier for the user to grasp the handle 102 by allowing passage of at least a portion of the user's fingers between the outer surface 38 of the vessel 20 and the grasping portion 110.

Figure 4:
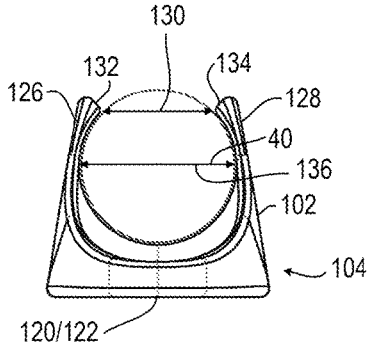
FIG. 4 is an end view of the vessel handle and paddle clip shown in FIG. 1 with the opposing side view being a mirror image thereof.

Looking to the end view of the handle 102 shown in FIG. 4, it can be seen that the paddle clip 104 comprises resilient arms 126 and 128 which also form part of the grasping portion 110. These resilient arms 126 and 128 have an opening width 130 at the distal ends 132, 134 thereof for passage of the shaft 202 of the paddle 200. The resilient arms 126, 128 spread (reposition away from each other) to allow passage of the shaft 202. In one example, this allows passage of the shaft 202 to a more proximal position to the outer surface 30 of the vessel. In the example shown, the paddle clip inner diameter 136 is larger than the opening width 130. In one example, it will be desired that the paddle clip inner diameter 136 inward of the distal ends 132/134 is substantially equal to the shaft outer diameter 40. Where the paddle clip inner diameter 136 is greatly smaller than the shaft outer diameter 40 of the paddle 200, the arms 126, 128 may be stressed over time and may not retain the paddle efficiently. Where the paddle clip inner diameter 136 is greatly larger than the shaft outer diameter 40, the arms 126, 128 may not contact the outer surface of the shaft 202, resulting in longitudinal movement and/or rattling of the paddle 200 within the paddle clip 104.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A combined vessel handle and paddle clip comprising:

a plurality of resilient arms each having an outer surface forming a substantially cylindrical grasping surface;

the plurality of resilient arms forming an interior surface with an inner diameter, the interior surface configured to frictionally retain a paddle shaft;

the plurality of resilient arms having distal ends forming an opening to the inner surface;

the resilient arms configured such that a portion of the paddle shaft will pass, spreading the distal ends of the resilient arms and be retained as the widest part of the paddle shaft passes the distal ends of the resilient arms;

a mounting surface at each longitudinal end of the resilient arms;

the substantially cylindrical grasping surface extending between the plurality of resilient arms;

the grasping surface extending between the mounting surfaces;

the grasping surface configured for the user to grab and lift the vessel with or without a paddle shaft;

an offset distance or gap between the grasping surface and the exterior surface of the vessel allowing passage of at least a portion of the user's fingers between the exterior surface of the vessel and the substantially cylindrical grasping surface; circumferentially around the paddle shaft;

the resilient arms, grasping surfaces, mounting surfaces forming a monolithic structure; and each mounting surface configured to mount the combined vessel handle and paddle clip to an exterior surface of the vessel.

2. A combined vessel handle and paddle clip comprising:

a plurality of resilient arms each having an outer surface forming an exterior grasping surface;

the plurality of resilient arms forming an interior surface with an inner diameter, the interior surface configured to frictionally retain a paddle shaft;

the plurality of resilient arms having distal ends forming an opening to the inner surface;

the resilient arms configured such that a portion of the paddle shaft will pass, spreading the distal ends of the resilient arms and be retained as the widest part of the paddle shaft passes the distal ends of the resilient arms;

the exterior grasping surface configured to be grasped by a user;

a mounting surface at each longitudinal end of the grasping surface;

each mounting surface configured to mount the combined vessel handle and paddle clip to an exterior surface of the vessel;

the exterior surface of the vessel;

a handle recess in the exterior surface of the vessel; and wherein the combined vessel handle and paddle clip is mounted to the recess of the vessel and thus substantially does not protrude outwardly of the surrounding exterior surface of the vessel beyond the handle recess.

3. The combined vessel handle and paddle clip as recited in claim 1 wherein the paddle clip inner diameter inward of the distal ends is configured to be substantially equal to an outer diameter of the paddle shaft.

4. The combined vessel handle and paddle clip as recited in claim 1 wherein each mounting surface comprises a surface defining a void configured to allow passage of a fastener therethrough, the fastener configured to mount the combined vessel handle and paddle clip to the vessel.

5. The combined vessel handle and paddle clip as recited in claim 1 wherein the mounting surfaces are in direct contact with the exterior surface of the vessel.

* * * * *